United States Patent [19]

Kuo

[11] Patent Number: 4,695,177

[45] Date of Patent: Sep. 22, 1987

[54] DENTIFRICE DISPENSING TOOTHBRUSH

[76] Inventor: Youti Kuo, 88 Foxbourne Rd., Penfield, N.Y. 14526

[21] Appl. No.: 830,467

[22] Filed: Feb. 18, 1986

[51] Int. Cl.[4] ..... A46B 11/02

[52] U.S. Cl. ..... 401/150; 132/84 R; 132/84 B; 401/135; 401/141; 401/176; 401/191

[58] Field of Search ..... 401/191, 150, 84, 135, 401/141, 146, 176; 132/84 R, 84 B, 84 D

[56] References Cited

U.S. PATENT DOCUMENTS

| | | | |
|---|---|---|---|
| 2,025,591 | 12/1935 | Folsom-Jones | 132/84 B |
| 2,445,571 | 7/1948 | Fuston | 401/191 X |
| 2,756,450 | 7/1956 | Stolareusky | 401/191 |
| 3,256,894 | 6/1966 | Sherman | 132/84 |
| 3,613,698 | 10/1971 | Fox | 132/84 D |
| 3,816,007 | 6/1974 | Fox | 132/84 X |
| 3,879,139 | 4/1975 | Dahl et al. | 401/135 |
| 4,039,261 | 8/1977 | Evans | 401/132 |
| 4,068,974 | 1/1978 | Meyer et al. | 401/150 |
| 4,116,570 | 9/1978 | Parenti | 401/155 |
| 4,201,490 | 5/1980 | D'Angelo | 401/175 |
| 4,221,492 | 9/1980 | Boscardin et al. | 401/184 |
| 4,467,822 | 8/1984 | Blackwell | 401/191 X |
| 4,511,068 | 4/1985 | Bossina | 222/257 |

FOREIGN PATENT DOCUMENTS

| | | | |
|---|---|---|---|
| 370954 | 4/1932 | United Kingdom | 401/84 |

*Primary Examiner*—Steven A. Bratlie
*Attorney, Agent, or Firm*—Fred L. Denson

[57] ABSTRACT

A dentifrice dispensing toothbrush is described which stores dentifrice material in its handle and deposits a controlled portion of the stored material directly onto the top of the brush surface. The toothbrush comprises (1) a housing which includes a handle, (2) a reservoir situated within the housing for storing dentifrice material, (3) a brush having bristles which are attached to and supported by a head member, (4) an applicator which is attached to the housing and which is used to deposit portions of the material directly onto the top of the brush surface, (5) a valve which controls the flow of dentifrice material from the reservoir to the applicator and (6) a pumping means for applying pressure to the stored dentifrice material so as to cause it to flow from the reservoir to the applicator. The dentrifrice material is stored either directly in the reservoir or in a removable cartridge which is inserted in the reservoir. The cartridge comprises a hollow cylinder and a backstop which is a circular shaped disc positioned within the cylinder.

The toothbrush is operated by depressing the brush member which causes dentifrice material to be pumped from the reservoir. This is coupled with a simultaneous action of extending the applicator to dispense a controlled portion of dentifrice material directly onto the top surface of the brush. The toothbrush can be conveniently and efficiently operated with one hand. Its features make it particularly suitable for use by the physically handicapped.

8 Claims, 16 Drawing Figures

DENTIFRICE DISPENSING TOOTHBRUSH

BACKGROUND OF THE INVENTION

1. Field of the Invention

The present invention relates to a toothbrush which has a reservoir for storing dentifrice material. More particularly, the invention relates to a toothbrush wherein the stored dentifrice material is conveniently applied directly onto the top surface of the brush.

2. Description of the Prior Art

There are a variety of toothbrushes in the prior art which store and dispense dentifrice material from the handle of the brush. Most of these brushes dispense the dentifrice material at the base of the brush where the bristles are attached to the brush head support. Typical patents which utilize this method for feeding dentifrice material to the brush include U.S. Pat. Nos. 4,221,492, 4,116,570 and 4,201,490. Bottom fed brushes tend to use excessive dentifrice material since the material must be forced through the bristles to reach the surface where it is useful. Moreover, such brushes are more difficult to clean since unused dentifrice material has a tendency to become clogged at the base of the bristles. This is hygienically undesirable.

Other prior art patents have recognized the shortcomings of bottom feed brushes. These patentees have attempted to overcome the problem by designing brushes which do not feed dentifrice material from the bottom. U.S. Pat. No. 4,039,261 discloses a brush having a series of specially designed hollow bristles. Dentifrice material is forced through the bristles and deposited on the top brush surface. Because conventional bristles are not used, the increased costs of the brush is a significant factor. Moreover, because there is no way to seal off the interior of the bristles when they are not in use, hygiene is also a factor. U.S. Pat. No. 3,879,139 describes a chimney made from bristles to facilitate movement of dentifrice material to the brush surface. This structure is inherently inefficient since dentifrice material is discharged at or near the bottom of the bristle chimney. U.S. Pat. No. 3,256,894 discloses a brush which includes a fountain-like applicator which is positioned immediately below the brush surface. Dentifrice material is fed to the applicator from the bottom, but is deposited on or near the brush surface. The disadvantage of this structure is realized when the brush is in use; when pressure is applied, the applicator contacts the users teeth and gums causing potential discomfort.

The brushes described in the referenced prior art require the use of two hands to conveniently and efficiently dispense dentifrice material onto the brush. The brush described in U.S. Pat. No. 4,221,492 can ostensibly be operated with one hand, but not without extreme difficulty. The handle which contains the dentifrice material is flexible on one side and rigid on the other side. The flexible side of the handle is manipulated to force dentifrice material from the handle to the brush while the rigid side of the handle is used to apply force while brushing. A high level of skill and dexterity are required while brushing to prevent additional dentifrice material from being squeezed from the handle. Thus, the user is required to apply pressure to the handle during brushing while at the same time exercising care not to simultaneously squeeze the handle which could cause more dentifrice material to be forced out of the handle.

There are no brushes described which are specially designed for those who have use of only one hand such as the physically handicapped. While none of the referenced patents describes a brush wherein dentifrice material is conveniently and directly applied onto the surface of the brush, some of the patentees have recognized the advantages in depositing dentifrice material in this manner.

SUMMARY OF THE INVENTION

In accordance with the present invention, a dentifrice dispensing toothbrush is provided which stores dentifrice material and deposits a controlled portion of the stored material directly onto the top of the brush surface. The toothbrush of the present invention comprises (1) a housing which includes a handle, (2) a reservoir situated within the housing for storing dentifrice material, (3) a brush having bristles which are attached to and supported by a head member, (4) an applicator which is attached to the housing and which is used to deposit portions of the material directly onto the top of the brush surface, (5) a valve which controls the flow of dentifrice material from the reservoir to the applicator and (6) a pumping means for applying pressure to the stored dentifrice material so as to cause it to flow from the reservoir to the applicator.

The dentifrice material is stored either directly in the reservoir or in a removable cartridge which is inserted in the reservoir. The cartridge comprises a hollow cylinder and a backstop which is a circular shaped disc positioned within the cylinder. The cylinder contains grooves on its inner wall surface while the disc contains a plurality of flexible, radially extending fingers positioned along its circumference. The outermost diameter of the disc together with its flexible, radially extending fingers is greater than the internal diameter of the cylinder so that the ends of the flexible, radially extending fingers are mated in the grooves. The angle and positioning of the finger tips in the grooves limit movement of the backstop to one direction only.

The toothbrush of this invention is operated by depressing the brush member which causes dentifrice material to be pumped from the reservoir. This is coupled with a simultaneous action of extending the applicator to dispense a controlled portion of dentifrice material directly onto the top surface of the brush. The toothbrush described herein can be conveniently and efficiently operated with one hand. In this regard, the structure permits the user to apply dentifrice material to a brush and for the user to brush his or her teeth with the use of one hand. This is of particular significance to physically handicapped persons and to persons having a limited degree of manual dexterity. Because the quantity and flow of dentifrice material are controlled, it is unnecessary to rely on vision when it is applied to the brush. Thus, the invention is also advantageous to the visually impaired. Additionally, the toothbrush of this invention is conveniently transported and saves space since the toothbrush and dentifrice material are combined in one structure. The means of applying dentifrice material to the top surface of the brush enables conventional means for cleaning the brush. Moreover, hygiene is promoted since the use of dentifrice material is personalized.

The invention and its objects and advantages will become more apparent by referring to the accompanying drawings and to the ensuing detailed description of the preferred embodiment.

BRIEF DESCRIPTION OF THE DRAWINGS

FIG. 6A shows the brush in its fully extended position and the applicator in its fully retracted position befroe any dentifrice material is applied to the brush surface. FIG. 6B shows the brush in a partially retracted position and the applicator in a partially extended position as dentifrice is initially pumped from the reservoir and deposited directly onto the brush surface. FIG. 6C shows the brush in its fully retracted position and the applicator in its fully extended position upon completion of the depositing of dentifrice maerial onto the brush surface.

DETAILED DESCRIPTION OF THE PREFERRED EMBODIMENTS

Figure 1:
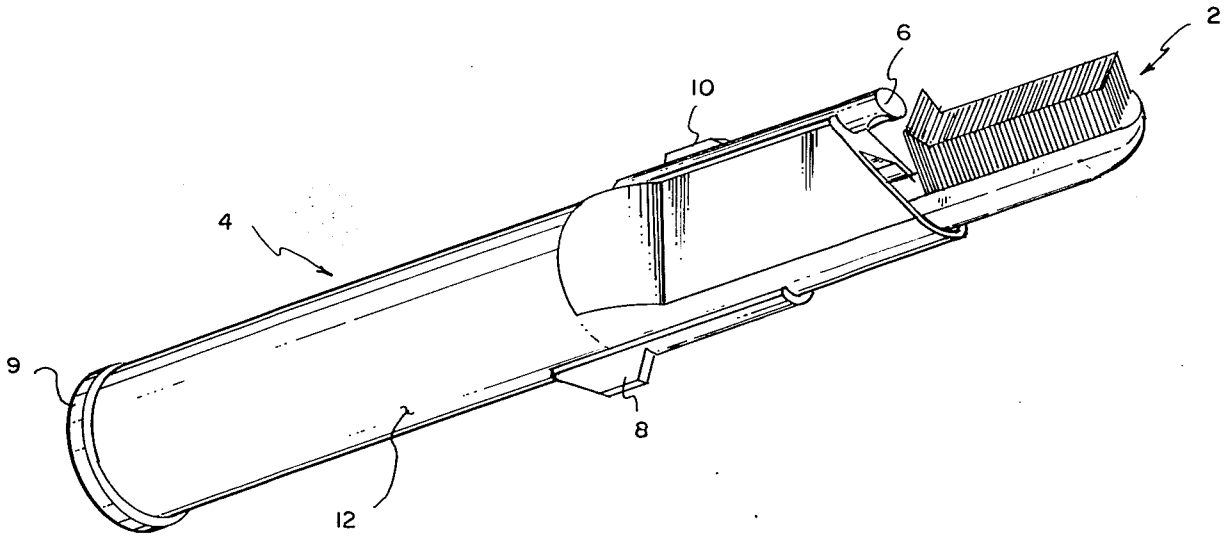
FIG. 1 is a perspective view of a dentifrice dispensing toothbrush according to this invention.

As shown in FIG. 1, the dentifrice dispensing toothbrush of the invention includes brush 2, housing 4 which includes a handle portion and base 9. Tubular shaped applicator 6 with applicator handle 10 is slidably attached to housing 4. Included within housing 4 is reservoir 12 which is used for storing dentifrice material. Pump handle 8 is used to pump dentifrice material from reservoir 12 to applicator 6 and subsequently onto the top surface of brush 2.

Figure 3A:
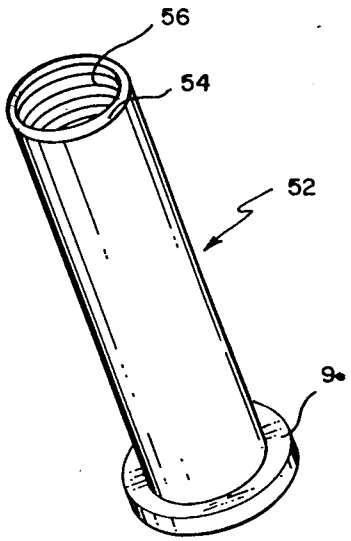
FIG. 3A is a perspective view of a cartridge which is inserted in the housing of the toothbrush of FIG. 2.
Figure 3B:
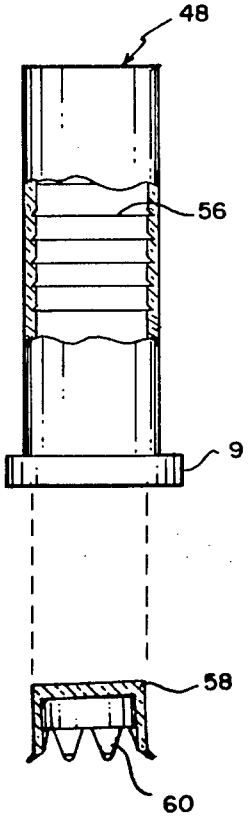
FIG. 3B is a cut away pictorial view of the cartridge of FIG. 3A and a backstop which is used with the cartridge.
Figure 3D:
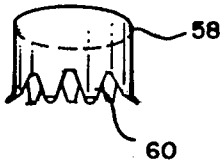
FIG. 3D is a perspective view of the backstop.
Figure 3C:
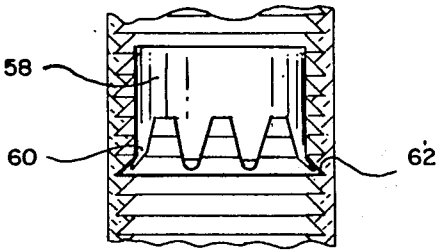
FIG. 3C is a partial sectional view of the cartridge of FIG. 3A with the backstop inserted in the cartridge.

The dentifrice material is either stored directly in reservoir 12 or, in accordance with a preferred embodiment, is stored in a container such as cartridge 52 of FIG. 3A. Cartridge 52 can be of any shape so long as its shape is compatible with the shape of reservoir 12. As shown in FIGS. 3A, 3B and 3C cartridge 52 is cylindrical in shape with wall 54 and flanged base 9 which also serves as the base for housing 4. A movable backstop comprising a disc 58 is inserted into the flanged end of cartridge 52 to prevent backflow and leakage of of dentifrice material contained therein. As dentifrice material is pumped from cartridge 52, disc 58 moves in a unilateral direction from the flanged end toward the open end of the cartridge. Backward movement, i.e. movement of the disc toward the flanged end 9 of the cartridge 52, is prevented by a plurality of flexible, radially extending fingers 60 which are positioned on the circumference of disc 58. The outermost diameter of the disc with the fingers is greater than the internal diameter of cartridge 52. Thus, when disc 58 is positioned in cartridge 52, the tips of fingers 60 contact the inner wall of cartridge 52. The stubbing force resulting from this contact prevents the backward movement of disc 58. In a preferred embodiment, the inner surface of cylinder wall 54 contains a series of circular grooves 56 having an angular pitch which enhances the uni-directional movement of disc 58. Backward movement of disc 58 is further prevented when the tips of fingers 60 are mated in position with grooves 56 as shown at 62 of FIG. 3C.

Cartridge 52 containing dentifrice material is inserted in reservoir 12. Disc 58 seals the bottom end of cartridge 52 and ensures that dentifrice material flows only from the open end 48 of cartridge 52. Cartridge 52 is removable. Thus, when all the dentifrice material is used, the empty cartridge is removed and replaced with a full cartridge which is inserted into reservoir 12.

Figure 2:
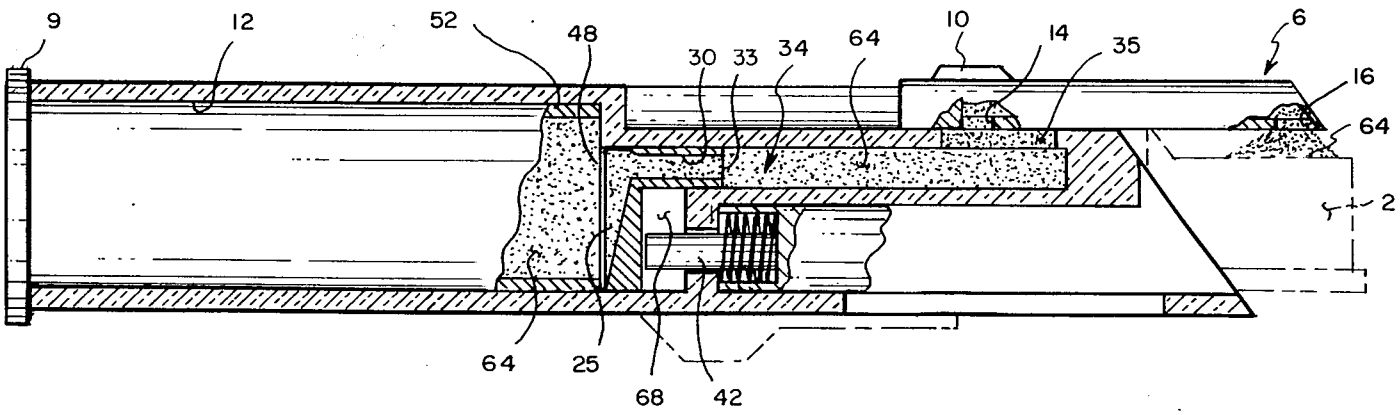
FIG. 2 is a front elevational view with a partial sectional view of the toothbrush shown in FIG. 1.
Figure 5C:
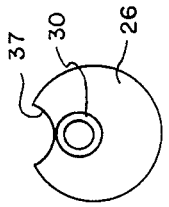
FIG. 5C is a plan view of the valve of FIG. 5B.
Figure 5B:
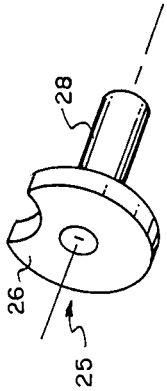
FIG. 5B is a perspective view of the valve which is positioned within the housing of FIG. 5A.
Figure 5D:
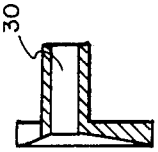
FIG. 5D is a front sectional view of the valve of FIG. 5B.
Figure 5E:
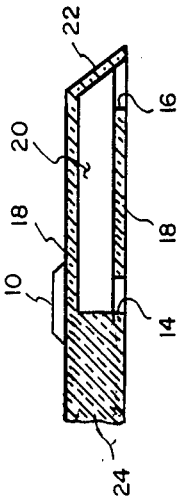
FIG. 5E is a sectional view of the applicator.
Figure 5A:
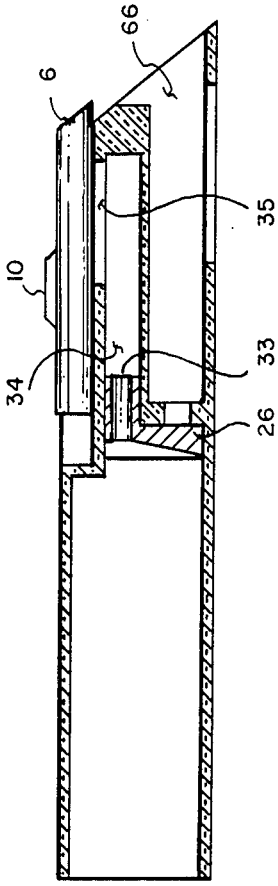
FIG. 5A is a front sectional view of the housing showing a valve positioned therein.

Referring to FIGS. 2 and 5A, valve 25 is positioned at the closed end of reservoir 12. The head of valve 25 is also adjacent to open end 48 of cartridge 52. The stem 28 of valve 25 is positioned in channel 34. As shown in FIGS. 5B, 5C and 5D, valve 25 contains valve head 26 and valve stem 28. Orifice 30 comprises an annular opening which extends longitudinally through valve head 26 and valve stem 28. Valve head 26 is preferably concave in shape to facilitate the flow of dentifrice material from cartridge 52 through orifice 30 to channel 34. A part of valve head 32 is removed in a preferred embodiment to allow space for the slidable movement of applicator 6 yet retain compactness of the assembly. Compactness is also enhanced by the off-center placement of valve stem 28 in relation to valve head 26.

Housing 4 is made of a moldable material. Thermoplastic resins are particularly suitable since they can be readily shaped using conventional molding techniques. Thus, housing 4 is molded to provide a wall for reservoir 12, a wall for channel 34, plunger well 66 and a concave recess for applicator 6. Channel 34 includes a first opening or inlet 33 and a second opening or outlet 35. Inlet 33 is in communication with valve orifice 30 while outlet 35 is in communication with inlet 14 of applicator 6 as shown in FIG. 2.

Applicator 6 is shown in FIG. 2 as being slidably mounted in a concave recess provided on housing 4. Applicator 6 has a tubular configuration with each of its ends, 22 and 24 being closed. In FIG. 5E, end 22 is slanted to conform to the general shape of the housing and to facilitate flow of dentifrice material through the applicator. The remaining end includes a solid portion 24 which is of sufficient length to block the flow of the dentifrice material into the concave recess when the applicator tube is in a fully extended dispensing position. It also prevents dentifrice material from become lodged in space which is not in the path of flow of the dentifrice material. An inlet 14 comprising a first opening in the side wall of applicator 6 is in communication with outlet 35 when dentifrice is pumped from reservoir 12 into tube channel 20. An outlet 16 comprising a second opening in the side wall of applicator 6 is positioned directly over brush 2 so that dentifrice material is deposited directly onto the top surface of brush 2. The length of dentifrice material which is deposited on the brush is controlled by the length of outlet 35. Applicator handle 10 assists the user in extending or retracting slidably mounted applicator 6.

Figure 4B:
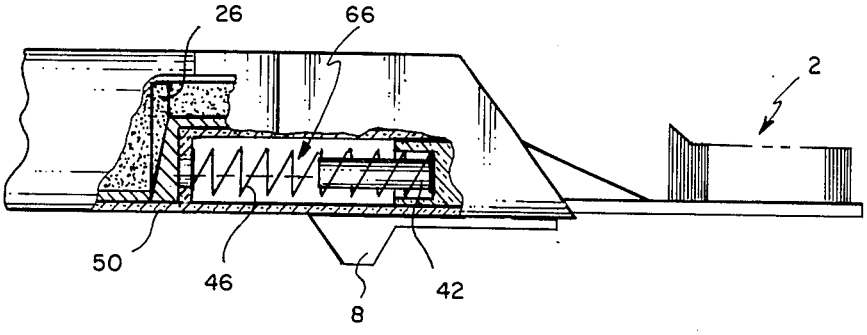
FIG. 4B is an orthographic view of the brush assembly of FIG. 4A with a partial cut away to show the brush assembly inserted in the housing.
Figure 4A:
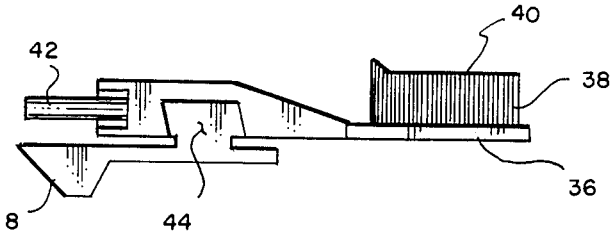
FIG. 4A is a orthographic view of the brush assembly of the dentifrice dispensing toothbrush of this invention.

The brush and plunger assembly is shown in FIGS. 4A and 4B. Brush 2 includes a set of bristles 38. The bottom end portions of the bristles are attached to brush head support 36. The top end portions are unattached and collectively provide a surface for supporting dentifrice material. The brush and plunger assembly also includes plunger 42 and means for releasably attaching the assembly to housing 4. A fastener such as 44 and a corresponding member (not shown) in the housing are particularly suitable for retaining the assembly in position in well 66. When inserted in well 66, plunger 42, plunger spring 46 and plunger spring support 50 provide a means for pumping dentifrice material from reservoir 12. A pulling force is initially applied to plunger 42 by a force applied to pump handle 8, which pulls the brush closer to applicator 6.

When a force is further applied to handle 8, spring 46 is compressed and plunger 42 contacts valve 25 causing it to move toward base 9. As valve 25 moves toward base 9, a partial vacuum is created in valve chamber 68 as shown in FIG. 2. The pumping force is transmitted to the dentifrice material 64 contained in cartridge 52. Because no backflow is possible, the dentifrice material 64, under increased pressure, is caused to flow from cartridge 52 through orifice 30 and into channel 34. When outlet 35 of channel 34 is aligned and in communication with applicator inlet 14, dentifrice material is forced into applicator 6. Simultaneously, a controlled portion of dentifrice material flows from applicator outlet 16 an is deposited onto the top of brush surface 40.

When the force applied to handle 8 is released, plunger 42 is caused to return to its original position by the reaction force of spring 46. The partial vacuum previously created in valve chamber 68 causes valve 25 to return to its original position. At the same time, a pressure lower than atmospheric pressure is thus created on the cartridge side of valve 25 which causes dentifrice material to move in with valve 25 to occupy the space of valve chamber 68. As dentifrice material moves toward valve 25, backstop 58 is also simultaneously moved in the same direction due to the pressure difference. As previously explained, the movement of backstop 58 is uni-directional because of the locking action provided by the positioning of fingers 60 into grooves 56 in wall 54 of cartridge 52.

Figure 6C:
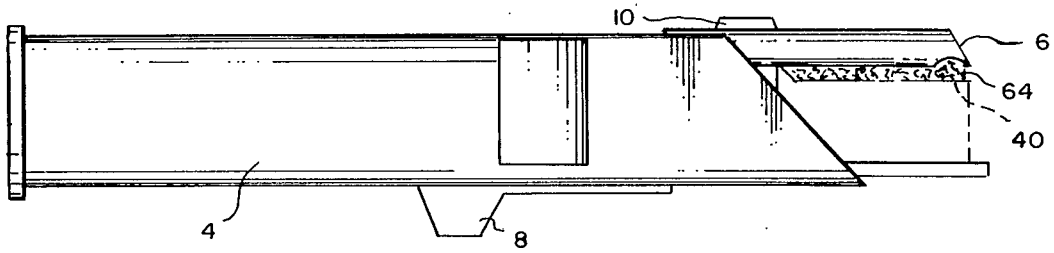
FIGS. 6A, 6B and 6C are plan views which show the relationship of the parts of the toothbrush when dentifrice material is applied to the brush surface.
Figure 6B:
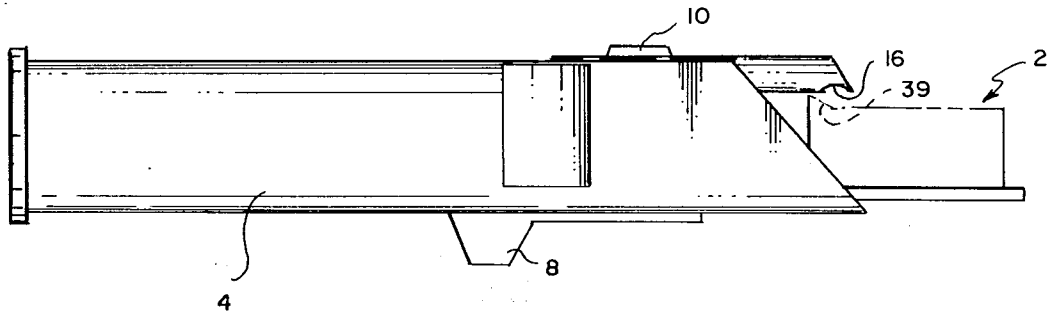
Figure 6A:
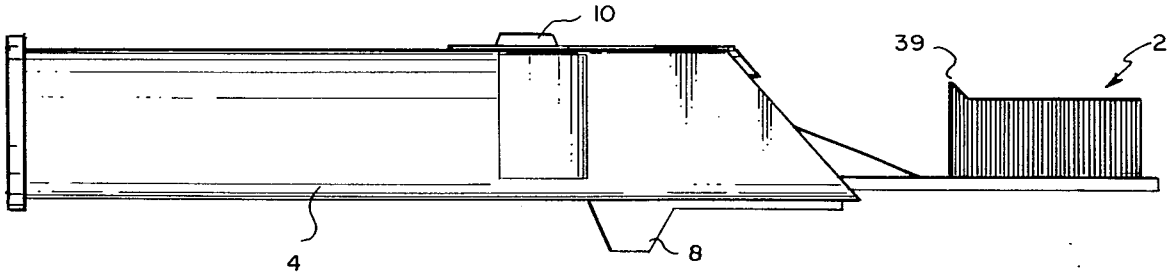

The operation of the dentifrice dispensing toothbrush of this invention is demonstrated in FIGS. 6A, 6B and 6C. While the user is holding the device by the handle part of housing 4 with one hand, the user's thumb and index finger are simultaneously used to apply opposite forces to pump handle 8 and applicator handle 10. The forces applied by the thumb and index finger cause brush 2 and applicator 6 to move towards each other. As brush surface 40 passes directly under applicator outlet 16, a controlled portion of dentifrice material is deposited directly onto the top of brush surface 40. The alignment of applicator outlet 16 and brush surface 40 are such that dentifrice material is deposited over a length on the brush surface. After the application is completed, the index finger and thumb apply opposite forces to handles 8 and 10 causing the applicator to become retracted and the brush to become fully extended and ready for use. Elongated bristles 39 at the lower end of brush 2 clean excess dentifrice material 64 from applicator outlet 16 as the applicator is retracted. After each use is completed, brush 2 is readily cleaned with water and the brush is ready for reuse. When applicator 6 is returned to its original position, outlet 16 becomes closed which also seals the dentifrice material contained on the device from the atmosphere. It is therefore prevented from caking or drying out when not in use.

Each of the parts which are in the path of flow of the dentifrice material are sealed so as to prevent unwanted leakage. The design of backstop 58 prevents leakage when dentifrice material is pumped from cartridge 52. Valve 25, plunger 42, applicator 6 and the housing 4 are interpositioned so as to provide enhanced flow and to provide seals against leakage of dentifrice material.

The advantages of the dentifrice dispensing toothbrush of the invention are readily apparent from the foregoing description. Its storage space is minimized since it is storable in an unright position on its base. Because dentifrice material is deposited directly onto the top surface of the brush instead of being applied from the bottom of the brush, it is easy to clean. The brush and the cartridge can be replaced without replacing the entire device thus providing an economic benefit. The application of a controlled portion of dentifrice material to the brush surface and the need for the use of only one hand to operate the device are beneficial to the visually and physically handicapped.

The invention has been described in detail with reference to a preferred embodiment thereof. However, it will be understood that variations and modifications can be effected within the spirit and scope of the invention. For example, applicator 6 can be stationary rather than slidable. If desired, handles 8 and 10 can be mechanically linked so that the movement of one causes movement of the other. Moreove, backstop 58 can be used in conjunction with cartridge walls which do not contain grooves. Also, flexible, radially extending fingers 60 can be replaced by a flexible annular flange which is positioned along the circumference of disc 58.

Other principles employed for the design and function of the dentifrice dispensing toothbrush of this invention are readily transferable to other useful applications.

I claim:

1. A dentifrice dispensing toothbrush comprising:

a. a housing;

b. a reservoir situated within the housing for storing dentifrice material;

c. a brush which contains a head member and a set of bristles having their bottom end portions attached to the head member and their top end portions unattached so as to collectively provide a brush surface for supporting dentifrice material, said brush being releasably attached to the housing;

d. an applicator for depositing dentifrice material directly onto the brush surface, said applicator being attached to the housing and being in communication with the reservoir;

e. a valve positioned in communication with the reservoir for controlling flow of dentifrice material from the reservoir to the applicator, said valve having a stem and a head and containing an orifice which extends longitudinally through the valve stem and valve head so as to provide an opening for the passage of dentifrice material which is pumped from the reservoir; and f. pumping means for applying pressure to cause dentifrice material to flow from the reservoir to the applicator.

2. The dentifrice dispensing toothbrush of claim 1 wherein the reservoir includes a removable container for storing dentifrice material.

3. The dentifrice dispensing toothbrush of claim 2 wherein the removable container comprises a hollow cylinder having a grooved inner wall surface and a circular disc positioned within the cylinder, said disc having a plurality of flexible, radially extending fingers positioned on the circumference of the disc, the outermost diameter of the disc having flexible, radially extending fingers being greater than the internal diameter of the cylinder whereby the ends of the flexible, radially extending fingers are mated in the grooves of the inner cylinder wall surface.

4. The dentifrice dispensing toothbrush of claim 1 wherein the pumping means comprises a plunger having one of its ends attached to the brush head member and its remaining end positioned so that it contacts and causes movement of the valve when a pumping force is applied to the plunger.

5. The dentifrice dispensing toothbrush of claim 1 including a channel situated within the housing for the passage of dentifrice material from the valve to the applicator, said channel having a first, inlet opening which is in communication with the valve orifice and a second outlet which is in communication with the applicator.

6. The dentifrice dispensing toothbrush of claim 5 wherein the applicator is slidably attached to the housing and comprises a tube having a side wall, two closed ends, a first inlet opening in the side wall which is in communication with the second, outlet opening in the housing channel when dentifrice material is pumped from the reservoir, and a second, outlet opening in the side wall which is positioned in a depositing relationship with the brush surface to permit dentifrice material to be deposited directly onto the brush surface when dentifrice material is pumped from the reservoir.

7. The dentifrice dispensing tootbrush of claim 2 wherein the removable container comprises a hollow cylinder having a grooved inner wall surface and a disc positioned within the cylinder, said disc having a plurality of flexible, radially extending fingers positioned on the circumference of the disc, the outermost dimension of the disc having flexible, radially extending fingers being larger than the largest internal dimension of the cylinder whereby the ends of the flexible, radially extending fingers are matable in the grooves of the inner wall surface.

8. A dentifrice dispensing toothbrush comprising:

a. a housing;

b. a reservoir situated within the housing;

c. a removable cartridge positioned in the reservoir, said cartridge comprising a hollow cylinder having a grooved inner wall surface and a circular disc positioned within the cylinder, said disc having a plurality of flexible, radially extending fingers positioned on the circumference of the disc, the outermost diameter of the disc having flexible, radially extending fingers being greater than the internal diameter of the cylinder whereby the ends of the flexible, radially extending fingers are mated in grooves of the inner cylinder wall surface;

d. a brush which contains a head member and a set of bristles having their bottom end portions attached to the head member and their top end portions unattached so as to collectively provide a brush surface for supporting dentifrice material, said brush being releasably attached to the housing;

e. a valve having a stem and a head which is positioned in communication with the reservoir to control flow of dentifrice material from the reservoir, said valve having an orifice which extends longitudinally through the valve stem and valve head so as to provide an opening for the passage of the dentifrice material;

f. a channel situated within the housing; said channel having a first, inlet opening which is in communication with the valve orifice and a second, outlet opening which is in communication with the applicator;

g. an applicator for depositing dentifrice material directly onto the brush surface, said applicator being slidably attached to the housing and comprising a tube having a side wall, two closed ends, a first inlet opening in the side wall which is in communication with the second outlet opening in the housing channel when dentifrice material is pumped from the reservoir, and a second outlet opening in the side wall which is positioned in a depositing relationship with the brush surface to permit dentifrice material to be deposited directly onto the brush surface when dentifrice material is pumped from the reservoir; and h. pumping means comprising a plunger having one of its ends attached to the brush head member and its remaining end positioned so that it contacts and causes movement of the valve when a pumping force is applied to the plunger.

* * * * *